US005118319A

United States Patent [19]

Smith et al.

[11] Patent Number: 5,118,319

[45] Date of Patent: Jun. 2, 1992

[54] TOY DOLL WITH SELF-CONTAINED LIGHT SHOW

[75] Inventors: Robin K. Smith, Long Beach; Daria Pietrowski, Huntington Beach; Doren Rosenthal, San Luis Obispo, all of Calif.

[73] Assignee: Mattel, Inc., El Segundo, Calif.

[21] Appl. No.: 652,571

[22] Filed: Feb. 8, 1991

[51] Int. Cl.[5] ..... A63H 3/00; A63H 33/22

[52] U.S. Cl. ..... 446/219; 446/485; 446/268

[58] Field of Search ..... 446/219, 485, 484, 268

[56] References Cited

U.S. PATENT DOCUMENTS

| | | | |
|---|---|---|---|
| 3,531,891 | 10/1970 | Goldfarb et al. | 446/485 X |
| 4,878,873 | 11/1989 | Yamaguchi et al. | 446/485 X |
| 4,934,940 | 6/1990 | Savery | 446/485 X |

OTHER PUBLICATIONS

"Giant Flash", Norstar Corp. catalog 1966.

*Primary Examiner*—Mickey Yu

[57] ABSTRACT

A doll including a body and appendages, a plurality of light positioned to light on portions of the doll, apparatus positioned within the doll for projecting an image to focus at a point outside of the doll, and apparatus for causing the lights to light in a predetermined sequence and the image to be projected from the doll.

6 Claims, 5 Drawing Sheets

TOY DOLL WITH SELF-CONTAINED LIGHT SHOW

BACKGROUND OF THE INVENTION

1. Field Of The Invention

This invention relates to toys and, more particularly, to a toy doll which includes apparatus for presenting a self-contained light show.

2. History Of The Prior Art

It is difficult for toy designers to design toys which appeal to children. Various methods are used to make toys more attractive. One method used by designers to make a toy desirable is to design the toy so that it appears to represent a known desirable creature. Thus, for example, toys are designed to look like glamorous movie stars or other personalities which fascinate children. Another method used by designers is to impart play value to a toy. That is, rather than simply sitting posed and requiring the child to imagine how the toy might act, the toy does one or more things that the real thing which the toy represents might do.

One type of activity which holds fascination for young and older children is the light show in which flashing multicolored lights and kaleidoscopic images are moved through a semi-darkened area. Such a light show tends to lend a feeling of magic to what would otherwise be common scenes making all things involved appear to be greater than life. To date there appears to have been no attempt made to create a light show involving a doll.

There have been, of course, dolls and other toys with various portions which have lighting which may be actuated by a child. For example, U.S. Pat. Nos. 4,673,371, Furukawa; 4,752,273, Woods; 4.655,721, Loomis et al; 3,808,418, Conard et al; 2,933,853, Laval; 2,932,917, Patane; 2,794,298, Mason; 2,647,222, Nieset; 1,805,823, Heilweil; 1,877,940, Morgenstern et al; and 2,036,328, Furey all relate to dolls or toys which have eyes which light on some occasion, usually the closing of a switch by a child. U.S. Pat. Nos. 4,464,861, Fogarty et al; 4,521,205, Spector; 4,547,171, Horimoto; and 4,585,424, DeMars, describe toys with translucent portions and interior lighting which cause the mouth or eyes of the toy to glow. U.S. Pat. No. 2,267,094, Halsey describes a doll which has a luminous outfit that glows in the dark to alleviate a child's fear of the dark. U.S. Pat. Nos. 3,030,856, Jordan; 3,885,865, Stern et al; and 4,285,028, Bundin et al relate to kaleidoscopic devices for projecting light. However, none of these have conveyed the feeling of the doll involved in a light show.

SUMMARY OF THE INVENTION

It is, therefore, an object of the present invention to provide a toy doll which is capable of creating its own light show.

It is another more specific object of the present invention to provide a doll which when actuated appears to be involved in a light show.

These and other objects of the present invention are realized in a doll, a plurality of light positioned to light on portions of the doll, means positioned within the doll for projecting an image to focus at a point outside of the doll, and means for causing the lights to light and the image to be projected from the doll in a predetermined sequence.

These and other objects and features of the invention will be better understood by reference to the detailed description which follows taken together with the drawings in which like elements are referred to by like designations throughout the several views.

DETAILED DESCRIPTION OF THE INVENTION

Figure 1:
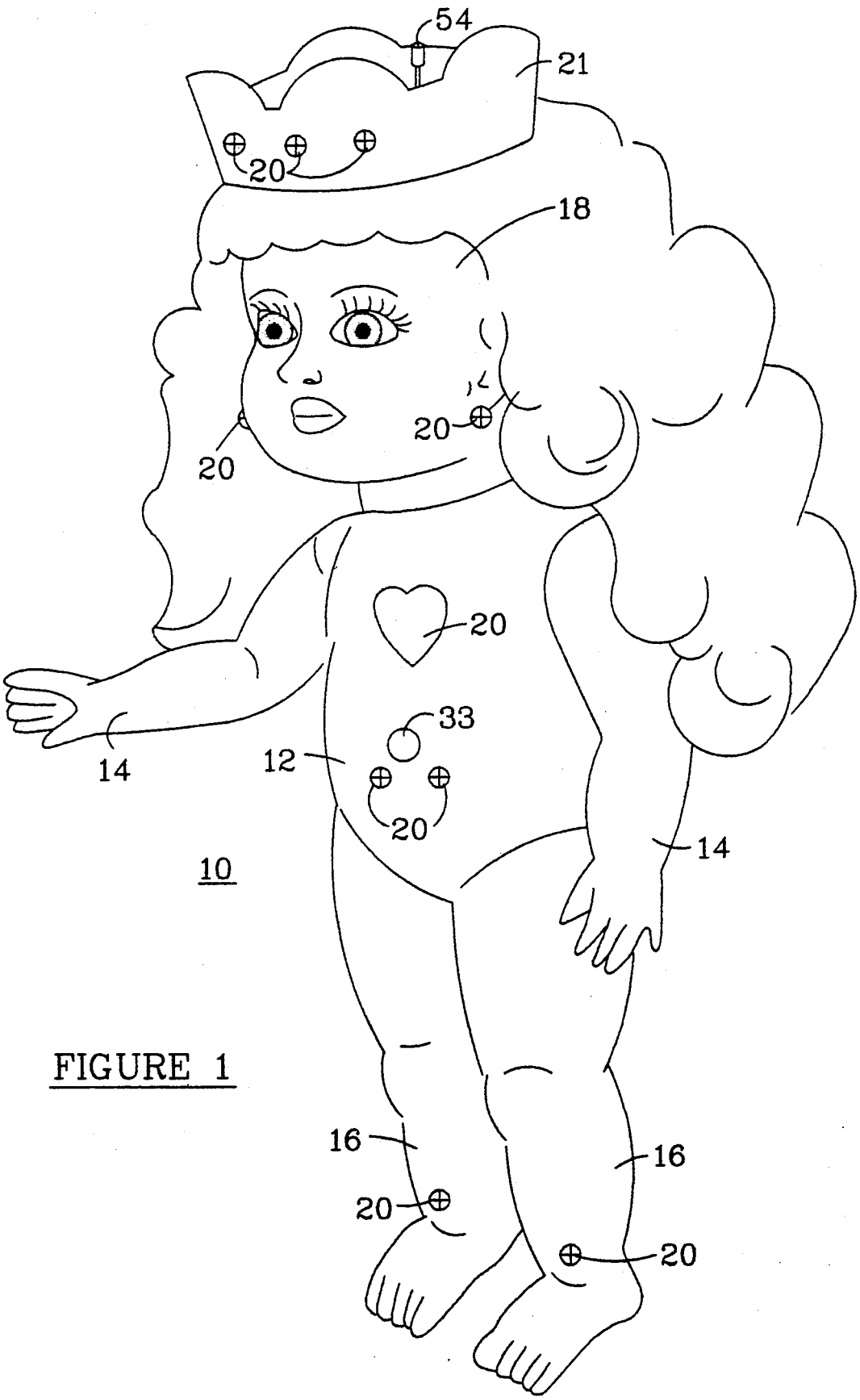
FIG. 1 is an isometric view of a doll constructed in accordance with the invention.

Referring now to FIG. 1, there is illustrated a doll 10 constructed in accordance with invention. The doll 10 includes a body portion 12, a pair of arms 14, a pair of legs 16, and a head 18. Positioned upon the various parts of the doll 10 are a series of ten lights 20 which may be turned on and off in a preselected sequence under the control of a child. The sequence of lights is chosen to make the doll 10 appear to be covered with flashing lights or sequins and to, thus, be involved in a light show. Each of these lights is positioned on or within the body or other appendage of the doll 10 behind a lens of plastic shaped to provide the effect of a jewel, an earring, or the like.

To add to the light show quality surrounding the doll 10 provided by the ten lights 20, a device within the doll 10 and not shown in FIG. 1 is designed to project a selected color picture. The projection device is positioned within the head 18 of the doll 10 in a manner which will be illustrated hereinafter so that the colored picture or pictures presented are projected through the top of the head of the doll and upward in the normal upright position of the doll 10. The projection from the head 18 is generally hidden by the provision of a crown 21 placed on the head. The beam of light is directed upward through the interior of the crown 21. The projection device may include an arrangement for causing the picture projected to move constantly to impart a kaleidoscopic appearance to the picture. Thus, if the lighting mechanism of the doll 10 is actuated by a child in a slightly darkened room, the lights 20 arranged on the doll 10 will sparkle in sequence and colored pictures which move will be projected upwardly onto any adjacent ceiling to provide the atmosphere one might experience at a typical light show. The order in which the effects occur may be varied by those skilled in the art although in the preferred embodiment the lighting of the sequence of lights and the projection of the picture occur simultaneously. The total effect provides a very substantial and convincing amount of play value to the toy.

Figure 2:
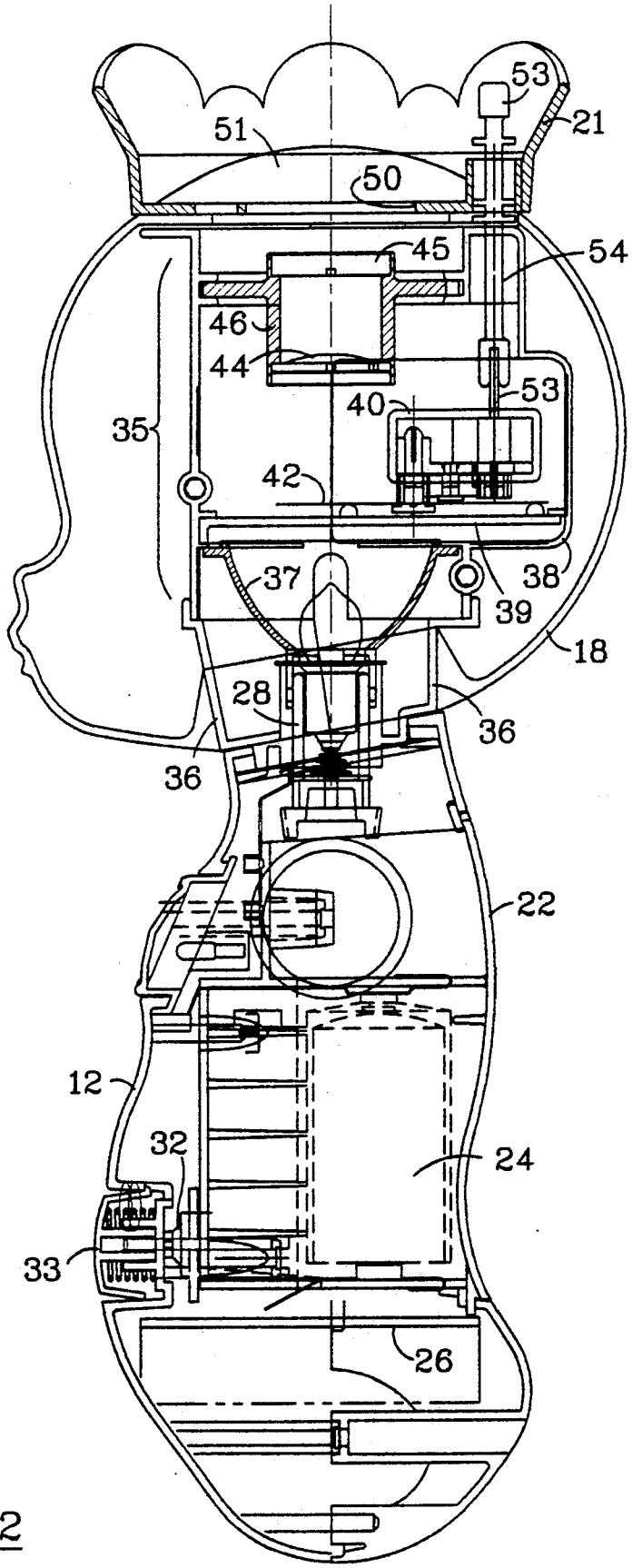
FIG. 2 is a side cross-sectional view of a doll constructed in accordance with the invention.

FIG. 2 illustrates a side cross-sectional view of the body 12 and head 18 of the doll 10. As may be seen, the exterior of the body 12 is formed of a hard plastic material such as ABS in order support the interior mechanism. The head 18, on the other hand, may be formed of a softer plastic material such as a plastisol compound as is the typical modern doll. A door 22 opens at the back of the doll 10 to provide access to a battery compartment 24 in which batteries for powering the operation of the doll 10 may be placed. In a preferred embodiment, a single nine volt transistor battery and a pair of C cell batteries are utilized to provide energy to a circuit board 26 mounted within the body 12 just below the battery compartment 24. The circuit board 26 mounts the electronic elements used to control the operation of the light show.

Above the battery compartment within the body 12 is positioned a bulb socket 28 which is of a conventional type adapted to hold and retain a flashlight bulb 30 which in the preferred embodiment is a type PR2 bulb. Power is provided in a manner to be described from the circuit board 26 to the socket 28 to light the bulb 30 through a pair of conductors which are not shown in the figure but which run through the interior space of the body 12. Positioned on the front of the doll 10 in a recessed position is a switch 32 which may be used to connect the power provided by the batteries to the circuit board 26. It should be noted that the switch 32 is operated by depressing a spring-mounted button 33 positioned where the navel of a doll would lie so that it is conveniently within reach of a child playing with the doll 10.

Positioned within the head of the doll 10 is an arrangement 35 discussed above for projecting images from within the head 18 upward so that they may be displayed on any overhead such as a ceiling. The arrangement 35 is supported upon a molded neck plug 36 which is held tightly within the opening in the upper body 12 of the doll through which the socket 28 extends. The molded neck plus 36 has a central opening which supports the socket 28 in a correct position. The upper portion of the neck plug 36 is molded to hold the base of the arrangement 35. A generally conical focusing element 37 which may be silvered on its interior surface surrounds the bulb and projects into the base of the arrangement 35 where it is held against the bottom of a container 38. The focusing element 37 is adapted to focus light from the bulb in the socket 28 upwardly to a lens system. The light passes through an open bottom of the container 38 in which the mechanism 40 of the arrangement 35 is mounted. An inner wall 39 in the container has an opening through which the light passes to project through a transparent positive print or image 42 which is to be displayed. The positive print 42 may be constructed of the material of which a photographic slide is made or some similar transparent material such as polyvinylchloride upon which an image may be placed for display. The positive print 42 is in the preferred embodiment a circular disk which rotates about an axis driven by the mechanism 40. The edge of the disk carrying the positive print 42 is seen in the view of FIG. 2. As the disk carrying the print 42 rotates about its center, a varying picture is placed in the path of the light beam for projection.

The path of the light beam continues through a lens system including a first lens 44 and a second lens 45. The two lenses 44 and 45 are held in place within a molded mounting 46 in the upper part of the container 38. The lenses 44 and 45 are selected in a manner well known in the art to focus the image of the positive print 42 approximately five feet above the head of the doll 10. In order to allow this to occur, the head of the doll 10 may be left open at the top, for example, a hole 50 may be left in the crown 21. In the preferred embodiment of the invention the hole 50 is covered with a transparent material 51 such as a plastic in order to seal and protect the inside of the head 18. It should be noted that the transparent material 51, though rounded, is shaped so that it does not affect the lens system. However, in an alternative embodiment, the transparent material 51 may be shaped to act as one of the lenses of the lens system for projecting the overhead image.

As may be seen in FIG. 2, the mechanism 40 has extending therefrom a shaft 53 upon which is placed a plastic arm terminating in a knob which extends to the exterior of the head 18 through a hole in the crown 21. The rotation of the knob rotates the shaft 53 and winds a spring (not shown) within the mechanism 40. The spring provides the force for driving the rotation of the positive print 42 (or other display to be projected).

Figure 3A:
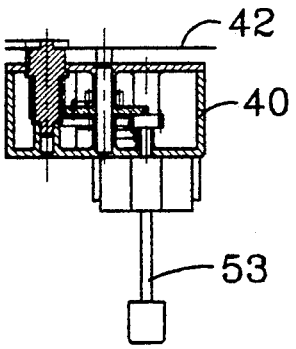
FIG. 3*a* is a cross-sectional view of a mechanism used in the doll illustrated in FIGS. 1 and 2.
Figure 3B:
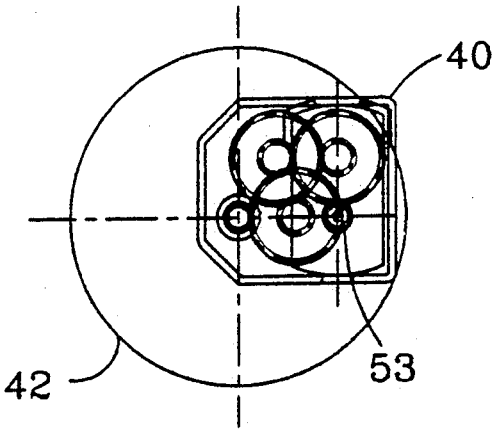
FIG. 3*b* is a top view of the mechanism illustrated in FIG. 3*a*.

FIG. 3*a* is a cross-sectional view of the mechanism 40 used in the doll 10 illustrated in FIGS. 1 and 2. FIG. 3*b* is a top view of the mechanism 40 used in the doll 10 illustrated in FIGS. 1 and 2. Although the details of the gearing of the mechanism 40 are clearly illustrated in these figures, that detail is not discussed because such simple spring driven devices are so well known is art. The details of that gearing serve only to determine how fast the print 42 rotates and how long the rotation continues, neither of which is a limiting factor to the present invention. Furthermore, the mechanism 40 might as well be an electrical motor or similar device well known to those skilled in the art for imparting rotation to the print 42.

Figure 4:
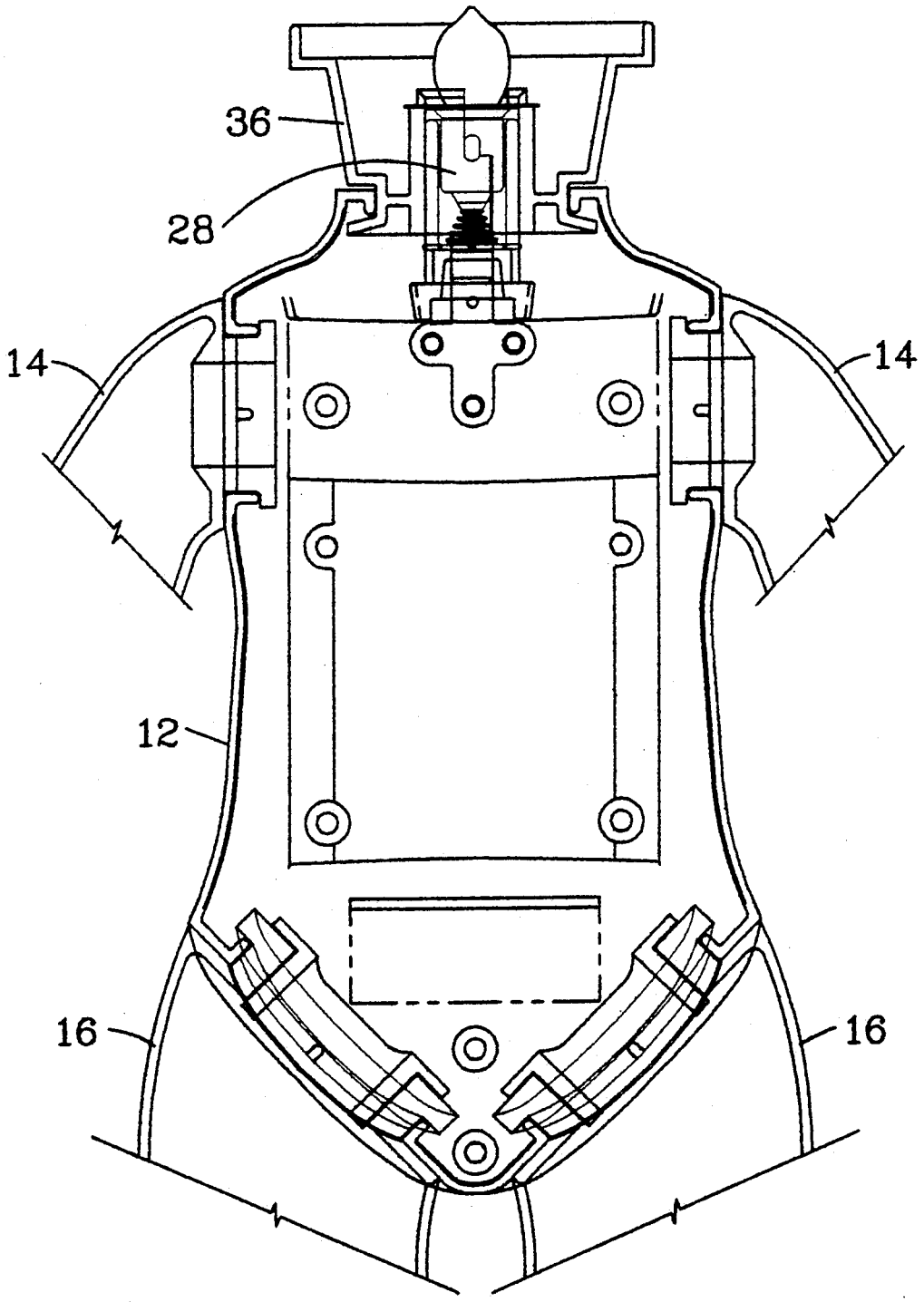
FIG. 4 is a front cross-sectional view of the back of the body of the doll illustrated in FIGS. 1 and 2.

FIG. 4 is a front cross-sectional view of the back of the body 12 of the doll illustrated in FIGS. 1 and 2. This view is included to illustrate the general conformation of the body 12 and to show how the arms 14 and legs 16 are joined to the body 12. The view also helps to describe the arrangement for mounting the projection bulb and the socket 28.

Figure 5:
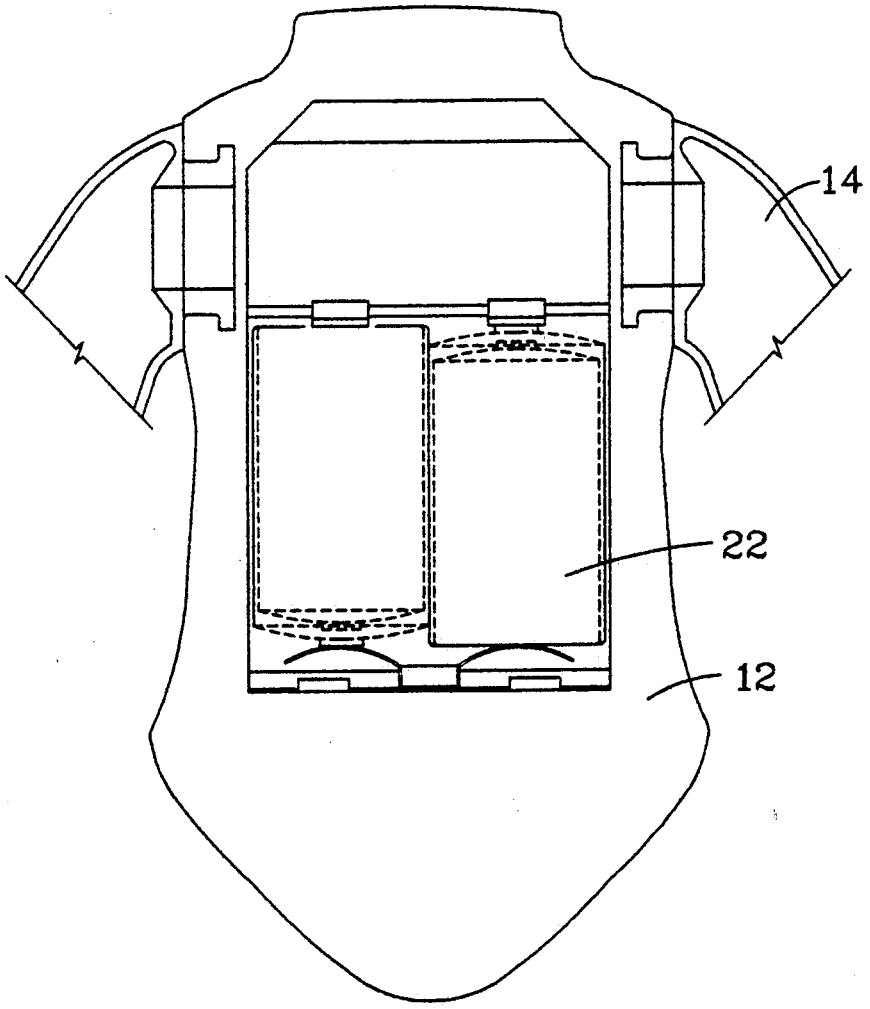
FIG. 5 is a back view of the body of the doll illustrated in FIGS. 1 and 2.

FIG. 5 is a back view of the body 12 of the doll 10 illustrating the door 22 for the batteries and the positioning of the C cell batteries within the body 12 of the doll 10.

Figure 6:
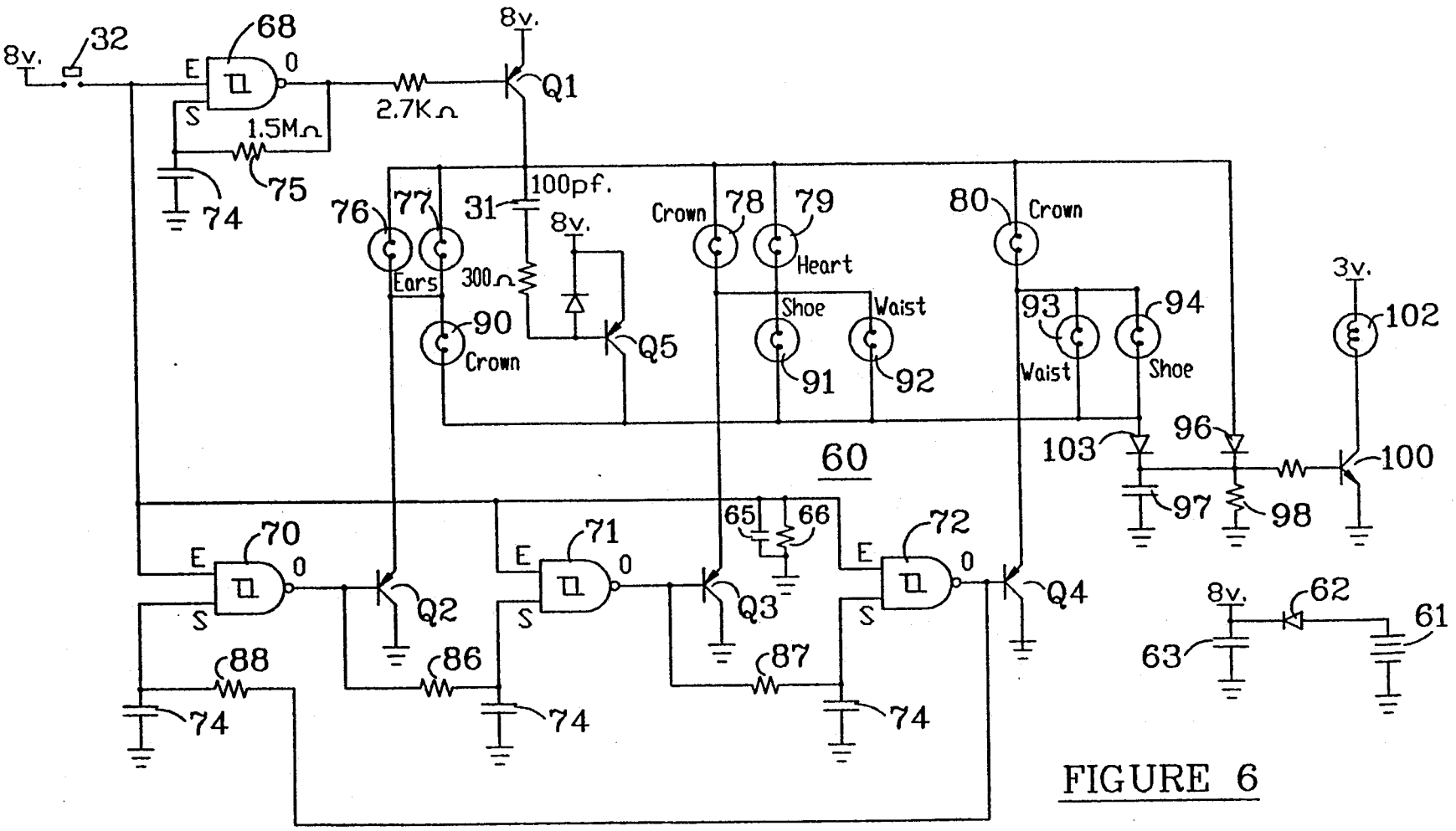
FIG. 6 is a circuit diagram illustrating a portion of the invention.

FIG. 6 is a circuit diagram illustrating the circuitry by which the sequence of flashing lights and the kaleidoscopic display are controlled. The circuit 60 includes a nine volt transistor battery 61 having its negative terminal grounded and its positive terminal connected through a diode 62 to provide an eight volt level for operating the circuit 60. The diode 62 is joined by a capacitor 63 to ground. The diode 62 assures that reversing the battery 61 will not destroy the circuit 60.

The eight volts provided by the battery 61 through the diode 62 are furnished to enable the operation of the body of the circuit 60 through a normally open switch 32. Closing the switch 32 charges an RC timing circuit which includes a capacitor 65 and a resistor 66 connected in parallel to ground. Normally the switch 32 is closed momentarily by a child, although it may be held on. The RC timing circuit including the capacitor 65 and the resistor 66 controls the time during which the circuit 60 remains in the operating condition. The charge on the capacitor 65 provides a positive enabling voltage at an enabling terminal E of four different Schmitt NAND gate circuits 68, 70, 71, and 72. Such Schmitt NAND gate circuits are available in sets of four as an integrated circuit generally referred to as quad Schmitt NAND gate circuit 4093 from a number of manufacturers (e.g., Fairchild as the F4093BC, BM).

These circuits are adapted to provide output at an output terminal (marked O in the figure) which is high if either input terminal is low and which is low if both input terminals are high. Thus, these circuits provide a square wave output at the output terminal O when a positive voltage is provided at the enable input terminal E. The output signal is high when the voltage at the other input terminal (marked S) is low, and the output signal is low when the voltage at the input terminal S is high.

When the switch 32 is first closed a capacitor 74 (one is connected between ground and the S input terminal of each circuit 68, 70, 71, and 72) will have been charged through the interior biasing of the Schmitt NAND circuits so that the voltage at the S input terminal to each of these circuits is high. For this reason the output terminal O of each of these circuits is low. The NAND circuit 68 is connected as an oscillator so the low voltage at the output terminal O of the circuit 68 discharges the capacitor 74 at input terminal S of the circuit 68 through a resistor 75, the timing of the charging being controlled by the RC values of the resistor 75 and the capacitor 74. The initial low voltage at the output terminal O of the circuit 68 at the base terminal of a transistor Q1 turns that transistor on. Ultimately, the capacitor 74 discharges sufficiently to switch the circuit 68 so that a high output is provided at the output terminal O of the circuit 68 and to the base of the transistor Q1. This turns the transistor Q1 off.

Prior to this happening, however, the transistor Q1 applies the eight volts at its emitter (less the emitter-collector voltage drop) to one terminal of each of five lamps 76–80. These lamps are a portion of the lamps 20 on the doll 10 which light in sequence. The other terminal of the lamps 76 and 77 (which are positioned at the earrings of the doll 10) are connected to the emitter terminal of a transistor Q2. The base of the transistor Q2 is connected to the output terminal of the circuit 70. The other terminal of the lamps 78 and 79 (which are positioned at the crown and heart of the doll 10) are connected to the emitter terminal of a transistor Q3. The base of the transistor Q3 is connected to the output terminal of the circuit 71. The other terminal of the lamp 80 (which is positioned at the crown of the doll 10) is connected to the emitter terminal of a transistor Q4. The base of the transistor Q4 is connected to the output terminal of the circuit 72.

When the switch 32 is closed, all of the capacitors 74 connected at the input terminal S of the circuits 70–72 will have been charged by the internal biasing of the Schmitt circuits. Consequently, the enable signal at the E terminals of each of these circuits will cause the high valued input signal to produce a low valued output signal at the output terminal O of each of these circuits 70–72; and each of the transistors 82–84 will be momentarily conducting. Since the transistors 82–84 are on, all of the lights 76–80 will go on momentarily.

The output terminal O of the circuit 70 is connected to provide a discharge path for the capacitor 74 at the input terminal S of the circuit 71 through a resistor 86. The output terminal O of the circuit 71 is connected to provide a discharge path for the capacitor 74 at the input terminal S of the circuit 72 through a resistor 87. The output terminal O of the circuit 72 is connected to provide a discharge path for the capacitor 74 at the input terminal S of the circuit 70 through a resistor 88. Because no two resistors and capacitors timing the circuits 70–72 are precisely the same, one of the capacitors 74 will discharge faster than the others and reduce the voltage at the input terminal S of its associated Schmitt circuit 70–72 to switch the circuit output from low to high. When the output goes high, the associated transistor (transistor Q2 for circuit 70, for example) will turn off causing the lights joined to its emitter to turn off as ground applied through the transistor to the other terminal of the connected lights is removed. This high value at the output terminal O of the circuit 70 will maintain the capacitor at the input terminal S to the circuit 71 high so that the transistor Q3 continues to conduct and the lights 78 and 79 stay on. However, after some period, the low output at the circuit 71 will discharge the capacitor 74 at the input terminal S to the circuit 72 sufficiently to switch that circuit 72 and turn off the associated transistor 84 and the connected light 80. This again charges the input capacitor 74 for the circuit 70 so that it will ultimately switch and provide a low output for turning on the transistor Q2 and the lights connected through it. This on/off sequence continues with of the lights 76–80 so long as the transistor Q1 remains on.

During this time, the circuit 68 has been providing a low value at its output terminal O to maintain the transistor Q1 on for lighting the lights 76–80. However, the low voltage at the output terminal O of the circuit 68 ultimately discharges the capacitor 74 connected at the input terminal of that circuit 68 so that the circuit 68 switches and provides a high output. This high valued output switches off the transistor Q1 causing whichever ones of the lights 76–80 are on to turn off.

The turn-off of the transistor Q1 generates a negative pulse (from ground through the lamps which are on) which is applied to the base of a transistor Q5 to turn that transistor on. The pulse is applied through a capacitor 81 and a resistor 85. The transistor Q5 applies eight volts at its emitter terminal to one terminal of each of a second number of lights 90–94 (a portion of the lights 20). The light 90 in the crown of the doll 10 has its other terminal connected to the emitter of the transistor Q2, the light 91 in one shoe and the light 92 in the waist of the doll 10 have their other terminals connected to the emitter of the transistor Q3, and the light 94 in one shoe and the light 93 in the waist of the doll 10 have their other terminals connected to the emitter of the transistor Q4. Consequently, the lights connected to the "on" one of the transistors 70–72 turn on, and other lights follow those lights in lighting in sequence. The time constant provided by the capacitor 81 and the resistor 85 is such that the transistor Q5 will remain on essentially the same time as the transistor Q1 was on. In this manner, the lights on the body and appendages of the doll 10 are enabled.

During the same period that the lights 76–80 are being lighted in sequence, a high voltage is applied through the transistor Q1 and a diode 96 to charge a capacitor 97 which is part of a timing circuit including a resistor 98. The high voltage charging the capacitor 97 is also applied at the base of a transistor 100 to complete a circuit to the lamp 102 which is used to project the image of the picture 42. The lamp 102 is connected to receive three volts from the two C cells discussed previously. When the transistor Q1 switches off and the transistor Q5 comes on, the eight volts furnished by the transistor Q5 to the lights 90–94 is also furnished to the capacitor 97 to maintain its charge and to the base of the transistor 100 to maintain that transistor and the current through the lamp 102 on. Thus, the two diodes 96 and 103, in effect, provide full wave rectification to maintain the lamp 102 on during the entire time that the two sequences of lights are turning on and off.

Ultimately, the capacitor 65 of the timing circuit controlling the on time of the entire circuit 60 discharges sufficiently through the resistor 66 that the enabling input to the circuits 68, 70, 71, and 72 is removed. When this happens, the output of each of these Schmitt NAND circuits goes high turning off each of the associated transistors Q2, Q3, and Q4. When the transistors Q2–Q4 turn off so do all of the lights connected through those transistors, and the light show ends.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A doll comprising a body and appendages, a plurality of lights positioned to light portions of the doll, means positioned within the doll for projecting an image to focus at a point outside of the doll, and means for causing the lights to light in a predetermined sequence and the image to be projected from the doll.

2. A doll as claimed in claim 1 in which the means positioned within the doll for projecting an image to focus at a point outside of the doll further comprises means for generating a beam of light, means for moving an image carried by a transparent medium in front of the beam of light, and a lens system for focusing the image produced by the beam of light through the transparent image.

3. A doll as claimed in claim 1 in which the plurality of lights positioned to light portions of the doll are arranged on parts of the doll so that the doll appears to be participating in a light show.

4. A doll as claimed in claim 1 in which the means for causing the lights to light in a predetermined sequence and the image to be projected from the doll comprises a circuit arranged within the doll, the circuit comprising means for providing a first voltage to a first terminal of each of a predetermined number of the lights for a first predetermined interval, means for providing the first voltage to a first terminal of each of a second predetermined number of the lights for a second predetermined interval after the first predetermined interval, and means for providing a second predetermined voltage to a second terminal of each of the lights in a patterned sequence.

5. A doll as claimed in claim 4 in which the means for causing the lights to light in a predetermined sequence and the image to be projected from the doll further comprises a circuit arranged within the doll, the circuit comprising a projection bulb, and means for providing a voltage to a first terminal of the projection bulb, and means for providing a different voltage to a second terminal of the projection bulb during a predetermined interval in which the lights are lighting in sequence.

6. A doll as claimed in claim 1 in which the means for causing the lights to light in a predetermined sequence and the image to e projected from the doll comprises a circuit arranged within the doll, the circuit comprising a projection bulb, and means for providing a voltage to a first terminal of the projection bulb, and means for providing a different voltage to a second terminal of the projection bulb during a predetermined interval in which the lights are lighting in sequence.

* * * * *